US009780494B2

(12) United States Patent
Chen

(10) Patent No.: US 9,780,494 B2
(45) Date of Patent: Oct. 3, 2017

(54) ELECTRICAL CONNECTOR WITH METALLIC SHELLS WITH SACRIFICIAL FIXING PORTIONS

(71) Applicant: FOXCONN INTERCONNECT TECHNOLOGY LIMITED, Grand Cayman (KY)

(72) Inventor: Ding-Cherng Chen, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/228,205

(22) Filed: Aug. 4, 2016

(65) Prior Publication Data

US 2017/0040736 A1 Feb. 9, 2017

(30) Foreign Application Priority Data

Aug. 4, 2015 (TW) ..... 104125152 A

(51) Int. Cl.

| | |
|---|---|
| ***H01R 9/03*** | (2006.01) |
| ***H01R 13/627*** | (2006.01) |
| ***H01R 13/6581*** | (2011.01) |
| ***H01R 13/6593*** | (2011.01) |
| ***H01R 13/6595*** | (2011.01) |
| *H01R 12/70* | (2011.01) |
| *H01R 12/72* | (2011.01) |
| *H01R 107/00* | (2006.01) |

(52) U.S. Cl.

CPC ..... *H01R 13/6581* (2013.01); *H01R 13/6271* (2013.01); *H01R 13/6593* (2013.01); *H01R 13/6595* (2013.01); *H01R 12/7047* (2013.01); *H01R 12/722* (2013.01); *H01R 2107/00* (2013.01)

(58) Field of Classification Search

CPC ..... H01R 13/658; H01R 13/65802; H01R 13/6581; H01R 13/6593; H01R 13/518; H01R 13/6271; H01R 13/6275; H01R 9/03; H01R 13/627

USPC ..... 439/607.01, 607.55, 355, 357, 358

See application file for complete search history.

(56) References Cited

U.S. PATENT DOCUMENTS 5,611,708 A * 3/1997 Mizunuma ..... H01R 13/6275 439/357

5,836,774 A * 11/1998 Tan ..... H01R 13/6275 439/76.1

(Continued)

FOREIGN PATENT DOCUMENTS

TW M472349 2/2014

*Primary Examiner* — Chandrika Prasad

(74) *Attorney, Agent, or Firm* — Wei Te Chung; Ming Chieh Chang

(57) ABSTRACT

An electrical connector including an insulative housing comprises a first metallic shell including a first body and a first positioning section extending from the first body; and a second metallic shell including a second body and a second positioning section extending from the second body and aligned with the first positioning section in a first direction; wherein the second metallic shell integrally forms a fixing portion extending from the second positioning section and tightly attaching the first metallic shell onto the second metallic shell at their first and second positioning sections so as to form a receiving cavity surrounded by both the first body and the second body to receive the insulative housing.

11 Claims, 5 Drawing Sheets

(56) References Cited

U.S. PATENT DOCUMENTS

| | | | | | |
|---|---|---|---|---|---|
| 5,971,790 | A * | 10/1999 | Rohde | H01R 13/627 | 439/350 |
| 6,165,017 | A * | 12/2000 | Kuo | H01R 13/6275 | 439/357 |
| 7,252,548 | B2 * | 8/2007 | Huang | H01R 13/65802 | 439/607.01 |
| 7,878,855 | B2 * | 2/2011 | Li | H01R 13/65802 | 439/607.04 |
| 8,550,839 | B2 * | 10/2013 | Fabian | H01R 13/506 | 439/460 |
| 2009/0280687 | A1 * | 11/2009 | Liu | H01R 9/032 | 439/607.55 |

* cited by examiner

ELECTRICAL CONNECTOR WITH METALLIC SHELLS WITH SACRIFICIAL FIXING PORTIONS

BACKGROUND OF THE INVENTION

1. Field of the Invention

The present invention relates to an electrical connector assembly including a first connector and a second connector, the second connector can be rotated from a first position to a second position relative to the first connector to synchronously lock and electrically contact with the first connector in the second position.

2. Description of the Related Art

The present spot-welding process via a laser technology usually uses a lock block coordinating with a fixture or other tools to clamp two metallic pieces tightly, however, which results in some problems. For example, the lock block need an extra space for placement and must be limited in a region spaced from the spot-welding region to avoid shutting out a laser beam shooting to the spot-welding region and the lock block probably makes a crush injury on the metallic pieces.

Therefore, a new design is required.

SUMMARY OF THE INVENTION

Accordingly, an object of the present invention is to provide an electrical connector with a metallic shell having a fixing portion for an automatic positioning.

In order to achieve the object set forth, an electrical connector including an insulative housing is disclosed, comprising a first metallic shell including a first body and a first positioning section extending from the first body; and a second metallic shell including a second body and a second positioning section extending from the second body and aligned with the first positioning section in a first direction; wherein the second metallic shell integrally forms a fixing portion extending from the second positioning section and tightly attaching the first metallic shell onto the second metallic shell at their first and second positioning sections so as to form a receiving cavity surrounded by both the first body and the second body to receive the insulative housing.

In order to achieve the object set forth, a method of making an electrical connector is disclosed, comprising steps of: providing a second metallic shell which integrally forms a second body, a second positioning section, and a fixing portion; providing an insulative housing and assembling it onto the second metallic shell in a first direction; providing a first metallic shell which includes a first body and a first positioning section aligned with the second positioning section in the first direction and assembling it onto the insulative housing; and initially pressing first metallic shell toward the second metallic shell until the first positioning section is locked by the fixing portion, and then soldering the first positioning section and the second positioning section together.

Other objects, advantages and novel features of the invention will become more apparent from the following detailed description of the present embodiment when taken in conjunction with the accompanying drawings.

DETAILED DESCRIPTION OF THE INVENTION

Figure 1:
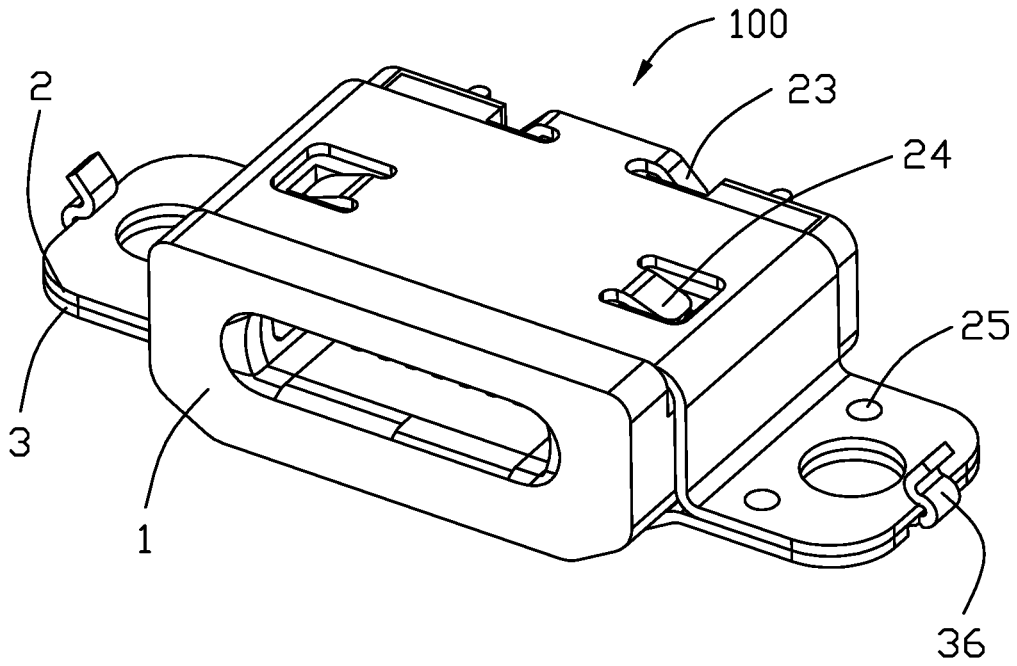
FIG. 1 is a perspective view of an electrical connector with fixing portions.
Figure 2:
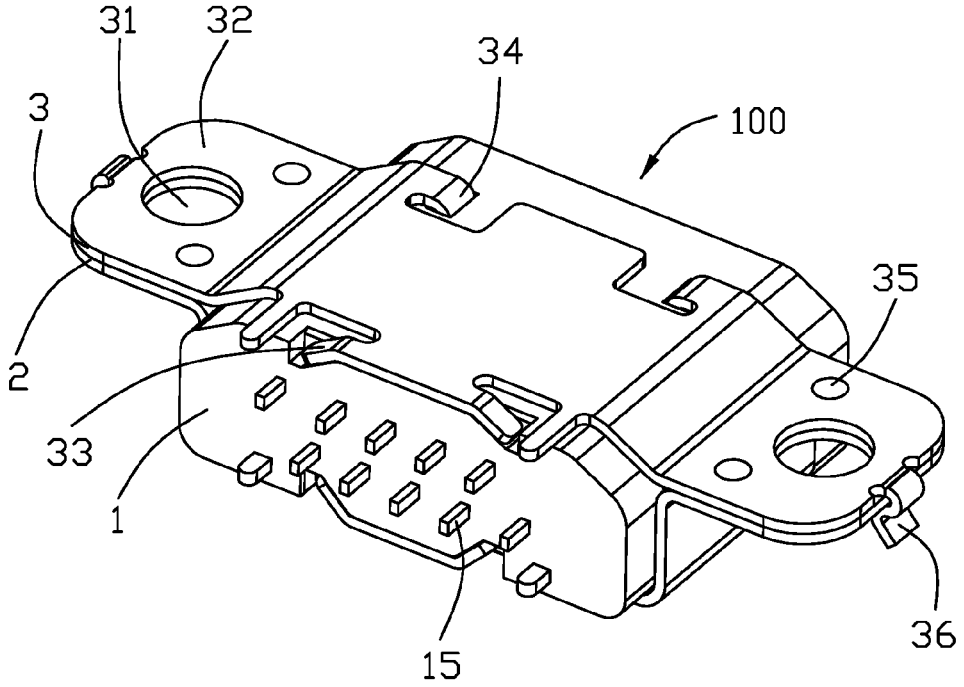
FIG. 2 is another perspective view of the electrical connector shown in FIG. 1.

Reference will now be made to the drawing figures to describe a preferred embodiment of the present invention in detail. Referring to FIG. 1 and FIG. 2, an electrical connector 100 includes an insulative housing 1, a first metallic shell 2 and a second metallic shell 3 commonly enclosing the insulative housing 1.

Figure 3:
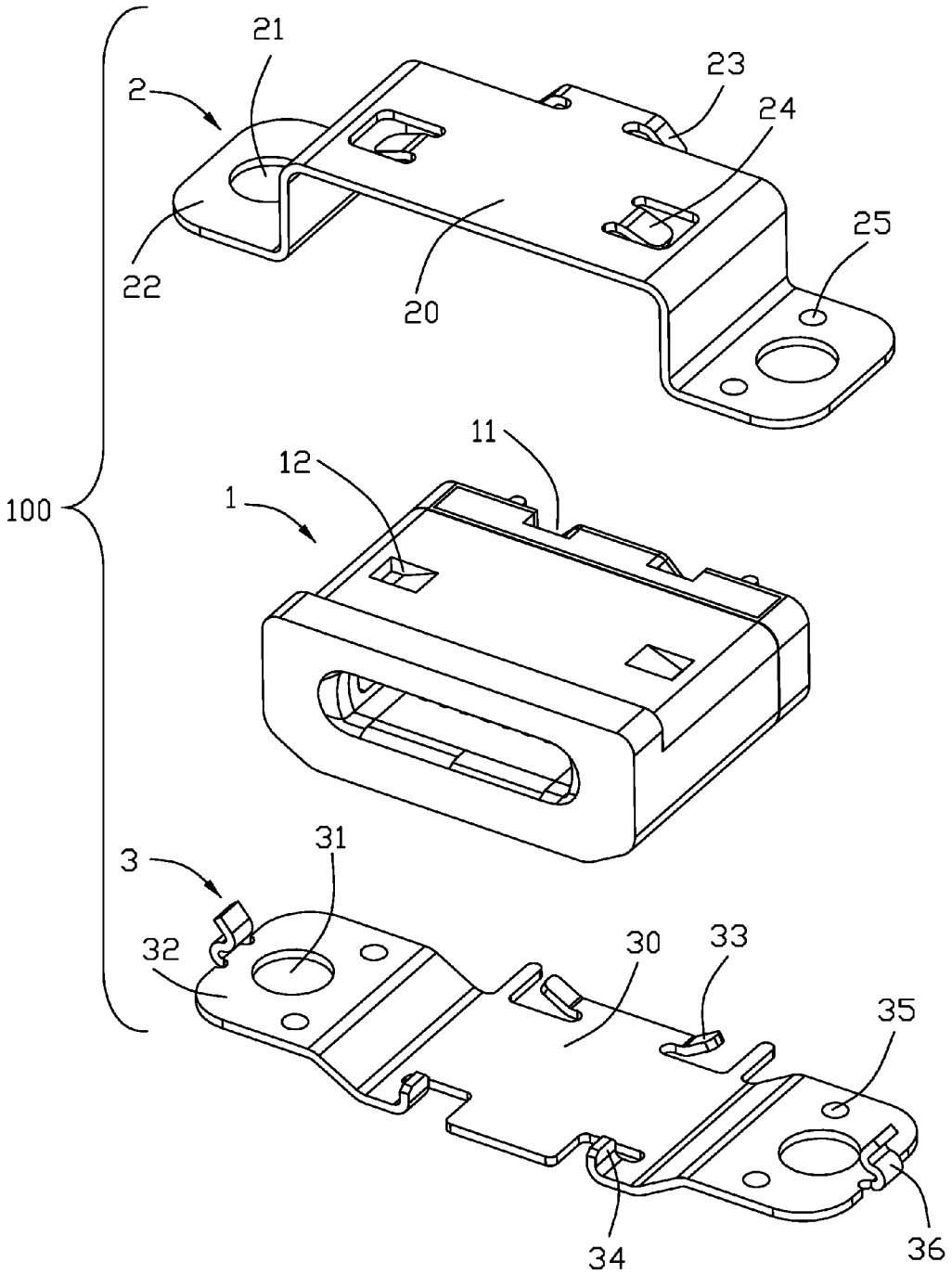
FIG. 3 is a partly exploded perspective view of the electrical connector shown in FIG. 1.
Figure 4:
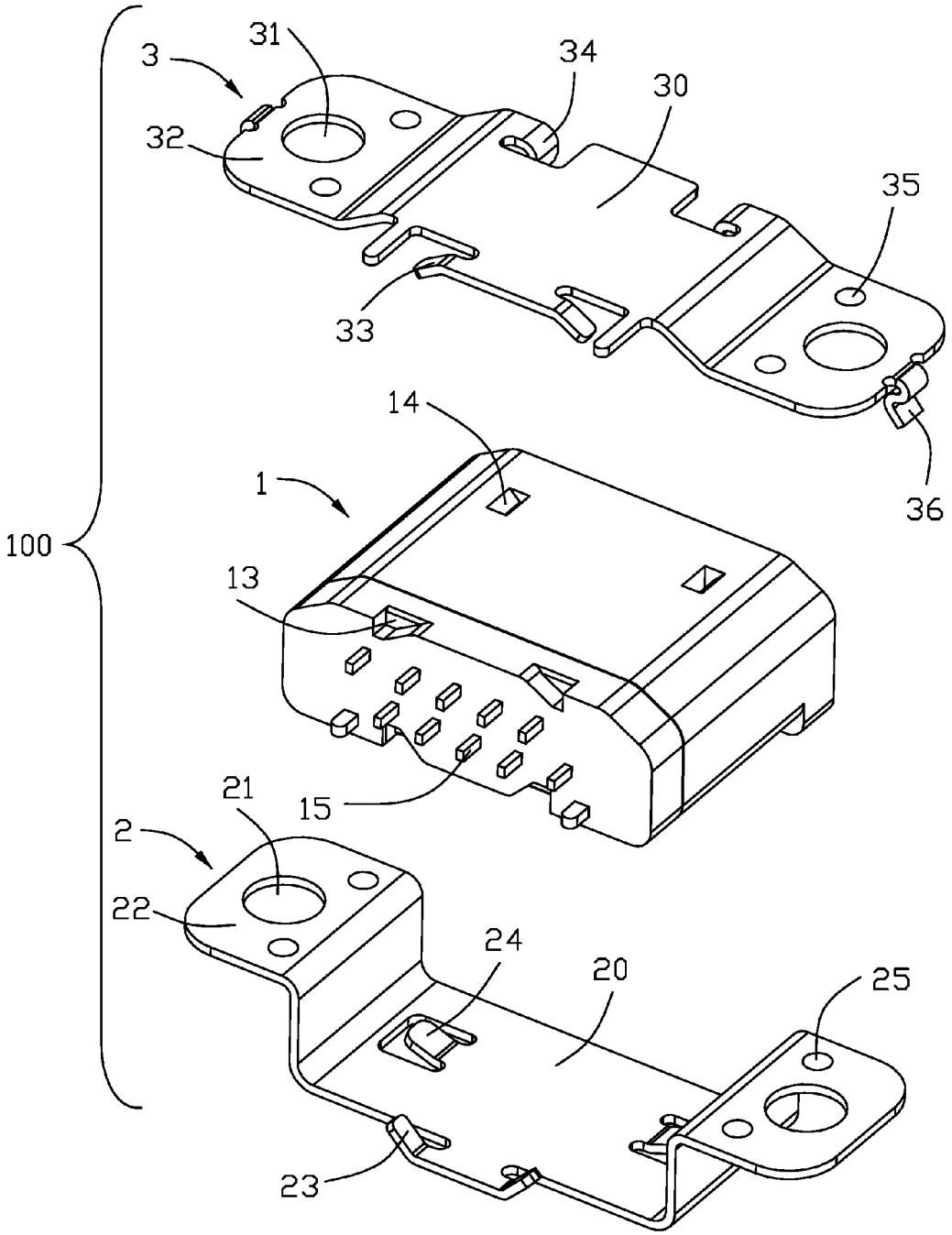
FIG. 4 is another partly exploded perspective view of the electrical connector shown in FIG. 3.

Referring to FIG. 3 and FIG. 4, the insulative housing 1 includes a plurality of terminals 15 retained therein and defines two opposite mating surfaces in an up-to-down direction to respectively mate with the first metallic shell 2 and the second metallic shell 3. Furtherly, the insulative housing 1 defines a pair of first locking notches 11 and a pair of first positioning notches 12 via pitting the top mating surface, and a pair of second locking notches 13 and a pair of second positioning notches 14 via pitting the bottom mating surface. Wherein the first locking notches 11 and the second locking notches 13 further go through a rear surface of the insulative housing 1 in a front-to-back direction perpendicular to both the traverse direction and the up-to-down direction.

The first metallic shell 2 includes a first body 20 and a pair of first positioning sections 22 respectively extending from two opposite sides of the first body 20 in a traverse direction perpendicular to the up-to-down direction, and a pair of first locking tabs 23 received in the first locking notches 11, and a pair of first positioning tabs 24 received in the first positioning notches 12. Both the first locking tabs 23 and the first positioning tabs 24 are formed integrally with the first body 20 by punching and stamping. The first metallic shell 2 also defines a pair of first locating holes 21 extending therethrough at the first position sections 22, respectively. Each first position section 22 also defines at least a first welding spot 25.

The second metallic shell 3 includes a second body 30 and a pair of second positioning sections 32 respectively extending from two opposite sides of the second body 30 in the traverse direction, and a pair of S-shaped fixing portions 36 respectively windingly extending from the second positioning sections 32 to the first positioning section 22 and flexibly clamping the first metallic shell 2 onto the second metallic shell 3. In this embodiment, each fixing portion 36 is integrally formed with the second metallic shell 3 and includes a guiding part and a receiving part, the first positioning section of the first metallic shell is guided smoothly into the receiving part by the guiding part. The second metallic shell 2 also includes a pair of second locking tabs 33 and second positioning tabs 34 respectively received in the second locking notches 13 and the second positioning notches 14. Both the second locking tabs 33 and the second positioning tabs 34 are formed integrally with the second body 30 by punching and stamping. The second metallic shell 3 also defines a pair of second locating holes 31 extending therethrough at the second position sections 32 and aligned with the first locating holes 21 in the up-to-down direction, respectively. Each second position section 32 also defines at least a second welding spot 35 aligned with the second welding spot 25 in the up-to-down direction.

In the front-to-back direction, the second metallic shell 3 has the same width with the first metallic shell 2 at their first positioning sections 22 or second positioning sections 32, which is conducive to aligning the first metallic shell 2 and the second metallic shell 3 in the up-to-down direction. In this embodiment, the first body 20 and the second body 30 commonly form a receiving cavity to receive the insulative housing 1, while each of the first positioning sections 22 and each of the second positioning sections 32 coordinate with each other to be mounted on a PCB (printed circuit board) via inserting a screw into the first locating hole 21 and the second locating hole 31 aligned therewith in the up-to-down direction.

When assembling, initially place the second metallic shell 3 into a mould, and then assemble the insulative housing 1 downward onto the second metallic shell 3 via the second locking notches 13 matching up with the second locking tabs 33 and the second positioning 14 matching up with the second positioning tabs 34, and then assemble the first metallic shell 2 downward onto the insulative housing 1 via the first locking tabs 23 matching up with the first locking notches 11 and the first positioning tabs 24 matching up with the first positioning notches 12 and meanwhile downwardly press the first metallic shell 2 until the first positioning sections 22 are respectively locked by the fixing portions 36 and then spot-weld the first metallic shell 2 and the second metallic shell 3 together via a laser technology, which forms the first soldering spot 25 and the second soldering spot 35 in a line with the first soldering spot 25, and finally remove out the fixing portions 36 from the second metallic shell 3.

Figure 5:
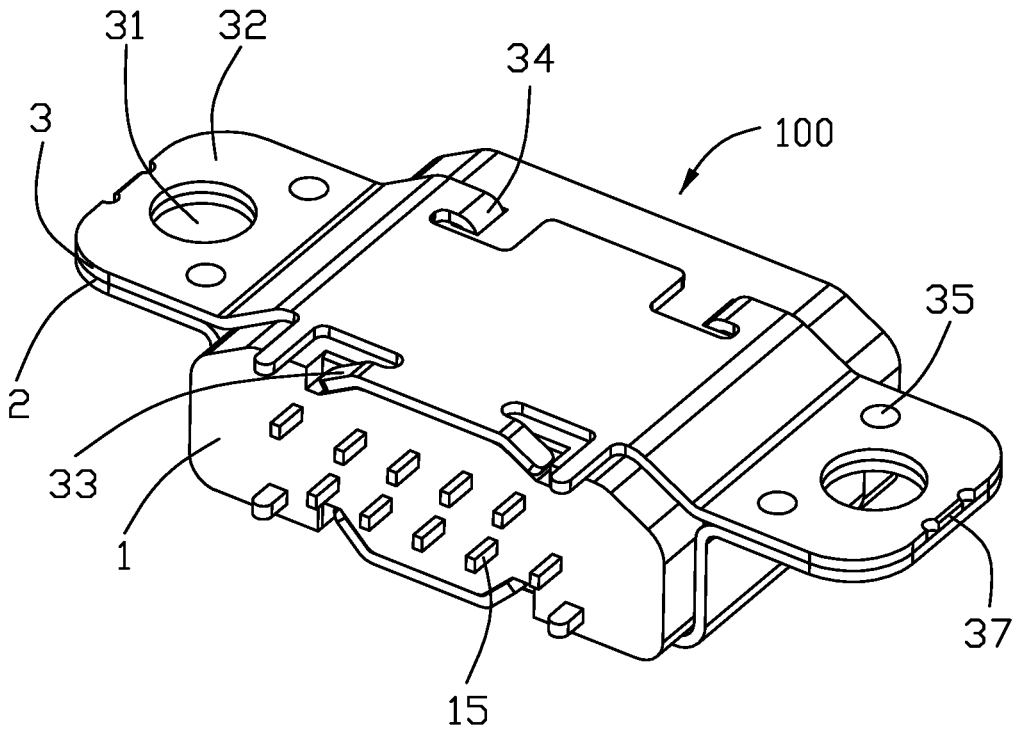
FIG. 5 is a perspective view of the electrical connector shown in FIG. 1, without the fixing portions.

Referring to FIG. 5, a cutoff leg 37 is formed as a fixing portion 36 is removed from each second positioning section 32 which further defines a pair of cuts formed on two sides of said cutoff leg 37 and adjacent to said cutoff leg 37.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector including an insulative housing, comprising:

a first metallic shell including a first body and a first positioning section extending from the first body; and a second metallic shell including a second body and a second positioning section extending from the second body and aligned with the first positioning section in a first direction;

wherein the second metallic shell integrally forms a fixing portion extending from the second positioning section and tightly attaching the first metallic shell onto the second metallic shell at their first and second positioning sections so as to form a receiving cavity surrounded by both the first body and the second body to receive the insulative housing, wherein the fixing portion is removed out after the first metallic shell and the second metallic shell are soldered together.

2. The electrical connector as described in claim 1, wherein the fixing portion of the second metallic shell is constructed as a flexible S-shape portion and includes a guiding part and a receiving part, and the first positioning section of the first metallic shell is guided into the receiving part by the guiding part.

3. The electrical connector as described in claim 2, wherein the first metallic shell is installed to the second metallic shell along said first direction in which direction the fixing portion of the second metallic shell extends windingly from the second metallic shell to the first metallic shell.

4. The electrical connector as described in claim 3, wherein there are two said second positioning sections at two opposite sides of the second metallic shell in a second direction perpendicular to the first direction, and two said fixing portions respectively extending from the two second positioning sections, and the first metallic shell forms two said first positioning sections respectively mating with the two fixing portions.

5. The electrical connector as described in claim 4, wherein each of the first positioning sections and the second positioning sections defines a locating hole extending therethrough and at least a soldering spot, wherein the soldering spot and the fixing portion are disposed adjacent to and around the locating hole.

6. The electrical connector as described in claim 4, wherein in a third direction perpendicular to both the first direction and the second direction, a width of the first positioning section is equal to that of the second positioning section for an alignment between the first metallic shell and the second metallic shell in the first direction.

7. The electrical connector as described in claim 3, wherein the insulative housing defines two opposite mating surfaces with a plurality of notches in said first direction onto which the first body of the first metallic shell and the second body of the second metallic shell are mated respectively, wherein the first body and the second body defines a plurality of tabs received in the notches.

8. An electrical connector comprising:

an insulative housing;

a plurality of terminals disposed in said insulative housing;

a first metallic shell including a first body and a pair of first positioning sections extending from two opposite sides of the first body; and a second metallic shell including a second body and a pair of second positioning sections extending from two opposite sides of the second body;

wherein said first and second bodies are corresponding to each other to form a receiving cavity with said insulative housing being received therein; said first and second positioning sections align to and lean on each other respectively, said respective first and second positioning sections are combined with each other by spot welding, at least one of said respective first and second positioning sections defines a cutoff leg formed on an edge thereof, wherein a fixing portion connected with the cutoff leg and clamped to other of the first and second positioning sections is cut off after spot welding.

9. The electrical connector as claimed in claim 8, wherein said one of said respective first and second positioning sections further defines a pair of cuts formed on two sides of said cutoff leg and adjacent to said cutoff leg.

10. The electrical connector as claimed in claim 8, wherein the fixing portion is constructed as a flexible S-shape and includes a guiding part for guiding said other of said respective first and second positioning sections and a receiving part for retaining said other of said respective first and second positioning sections.

11. The electrical connector as claimed in claim 8, wherein each of the first and second positioning sections defines a locating holes passing therethrough and a pair of welding spots formed by said method of spot welding and locating on two sides of said locating holes.

* * * * *